US011548597B2

(12) United States Patent
Salz

(10) Patent No.: US 11,548,597 B2
(45) Date of Patent: Jan. 10, 2023

(54) TENSION-STABILIZED KNOCK DOWN FURNITURE STRUCTURES ELIMINATING FASTENERS AND BRACES

(71) Applicant: David Salz, Davie, FL (US)

(72) Inventor: David Salz, Davie, FL (US)

( * ) Notice: Subject to any disclaimer, the term of this patent is extended or adjusted under 35 U.S.C. 154(b) by 0 days.

(21) Appl. No.: 17/172,675

(22) Filed: Feb. 10, 2021

(65) Prior Publication Data

US 2021/0219726 A1 Jul. 22, 2021

Related U.S. Application Data

(63) Continuation of application No. 16/216,734, filed on Dec. 11, 2018, now abandoned, which is a continuation of application No. 15/130,519, filed on Apr. 15, 2016, now Pat. No. 10,150,538.

(60) Provisional application No. 62/148,412, filed on Apr. 16, 2015.

(51) Int. Cl.

| | |
|---|---|
| ***A47C 4/02*** | (2006.01) |
| ***B63B 29/04*** | (2006.01) |
| ***A47C 7/28*** | (2006.01) |
| ***A47C 31/02*** | (2006.01) |
| *B63B 34/26* | (2020.01) |

(52) U.S. Cl.

CPC ..... *B63B 29/04* (2013.01); *A47C 4/02* (2013.01); *A47C 7/282* (2013.01); *A47C 31/023* (2013.01); *B63B 34/26* (2020.02); *B63B 2029/043* (2013.01)

(58) Field of Classification Search

CPC ... B63H 16/02; B63B 29/04; B63B 2029/043; B63B 2035/715; A47C 5/04; A47C 5/06; A47C 5/08; A47C 5/10

See application file for complete search history.

(56) References Cited

U.S. PATENT DOCUMENTS

| | | | | |
|---|---|---|---|---|
| 2,495,482 A | | 1/1950 | Rogatz | |
| 2,564,915 A | | 8/1951 | Nelson | |
| 2,865,436 A | * | 12/1958 | Thorne | A47C 7/282 297/440.11 |
| 3,437,375 A | | 4/1969 | Kettler | |
| 3,708,204 A | * | 1/1973 | Wachsmann | A47C 4/03 108/156 |
| 4,545,614 A | | 10/1985 | Abu-Isa et al. | |
| 4,583,778 A | | 4/1986 | Liebhold | |
| 4,784,436 A | | 11/1988 | Sutherland | |
| 5,393,126 A | | 2/1995 | Boulva | |

(Continued)

*Primary Examiner* — Syed A Islam

(74) *Attorney, Agent, or Firm* — Dale P. DiMaggio, Esq.; Malin Haley DiMaggio & Bowen, P.A.

(57) ABSTRACT

Tension-stabilized furniture structures and frame assemblies to form simplified flat packing furniture that eliminates all fasteners, welds and braces. Simplified assembly of pre-tensioned structures providing improved stability, uniformity of support and visual aesthetics. The seat cover material can be netting, fibrous material or textiles. The seating system includes outwardly angled side rails having the profile of furniture, such as seats, couches, chaise lounges, ottomans and the like. The angling of the side rails secures their connection to supporting cross rails with the application of a fitted cover sleeve. The sleeves slidingly engage the frame assembly and provide tension to the frame assembly resulting in highly stable furniture.

10 Claims, 8 Drawing Sheets

(56) References Cited

U.S. PATENT DOCUMENTS

| | | | | |
|---|---|---|---|---|
| 6,517,161 | B2 * | 2/2003 | Lo | A47C 5/06<br>297/440.11 |
| 2004/0145229 | A1 | 7/2004 | Tseng | |
| 2004/0222683 | A1 | 11/2004 | Simpson | |

* cited by examiner

TENSION-STABILIZED KNOCK DOWN FURNITURE STRUCTURES ELIMINATING FASTENERS AND BRACES

CROSS REFERENCE TO RELATED APPLICATIONS

This application claims the benefit of U.S. Provisional Application No. 62/148,412, filed on Apr. 16, 2015, related U.S. Utility application Ser. No. 15/130,519, filed on Apr. 15, 2016, now U.S. Pat. No. 10,150,538, and U.S. Continuation Utility application Ser. No. 16/216,734, filed on Dec. 11, 2018, now abandoned.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever.

BACKGROUND OF THE INVENTION

1. Field of the Invention

The present invention relates generally to furniture structures and improved seating systems, and more particularly to chairs, lounge seats, ottomans and other furniture having the instant novel tension-stabilized designs that eliminate support crossbars, braces, hardware, fasteners and the like, and greatly increase efficiency and simplify assembly.

2. Description of the Background Art

Any art described in this section is not intended to constitute an admission that any patent, publication or other information referred to herein is "prior art" with respect to this invention, unless specifically designated as such. In addition, this section should not be construed to mean that a comprehensive search has been made or that no other pertinent information as defined in 37 C.F.R. § 1.56(a) exists.

Conventional knock down furniture structures rely on fasteners, braces and hinges for stability, folding and assembly. Those mechanical parts are cumbersome, add expense in manufacturing, and bear the highest loads within those structures, therefore tending to be the primary points of structural failure.

For example, the Rogatz U.S. Pat. No. 2,495,482 teaches the use of a frame that is stabilized by screws that lock the tubes together at the foot end and by a rigid welded connection that locks them together at the head end. Those connections create a rigid frame that does not depend on a cover for stability or to hold the parts together. Forces applied to the frame will generate shear forces at the frame connections, where they are concentrated, creating the primary failure points of the structure.

The Bashaw U.S. Pat. No. 2,507,848 describes a support rack used for bathing infants in a sink or tub in an inclined plane. The rack is a rigid frame stabilized by two substantially U shaped members with foot portions and parallel vertical portions with insertion ends. The insertion ends are inserted into two parallel side pipes to form the rigid supporting frame. A material fabric cover with wide seams is used, and forms a passageway through which the supporting frame is passed.

The Sutherland U.S. Pat. No. 4,784,436 teaches the use of a rigid frame stabilized by eight push button fasteners and two hinges to create a knock down chair structure. The hinges experience high force loads in use and therefore become the primary points of structural failure in this device.

As a further example, Boulva U.S. Pat. No. 5,393,126 teaches the use of a composite rigid rod-like seat frame formed by closed loop members in a common plane and opposed rod-like end members integrally formed with diverging side members. A similar back frame and members is secured to the seat frame with a connecting bracket and attachment bars. A textile sleeve is tensioned by sliding over widening rigidly connected frames to create the seat and backrest surfaces. The textile sleeves serve the single function of support. The bracket connecting the two frames becomes highly loaded in use.

Another example is Simpson et al. U.S. Patent Application Publication No. U.S. 2004/0222683, which teaches the use of a textile sleeve over a rigid backrest frame having multiple interchangeable crossbars The cover includes an interior pocket to receive a crossbar which is in engagement with the back frame. The sleeve is tensioned by means of a removable crossbar.

U.S. Patent Publication No. 2004/0145229 issued to Tseng describes a detachable frame with U shaped side rails connecting to U shaped upper rails, and a divided web into a seat and back portion. A sleeve in the divided seat receives a backrest rod member. A string connects a corner of the web to a leg unit and the backrest rod member on each side.

As a further example of general a knock-down chair, U.S. Pat. No. 4,583,778 discloses a chair design have a swingable seat support a rigid framework that comprises a first U shaped cross piece with a pair of legs, and a second U shaped cross piece with a pair of legs, and they are pivotally connected for the members to swivel into collapsed and extended positions.

None of the prior art or conventional knock down furniture structures provide the simplicity of the instant user friendly assembly, the elimination of required hardware, braces or extraneous members, the inherent stability and self-tensioning, or the robustness of the instant furniture inventions, which constitute a substantial improvement over the art.

It is therefore an objective of the present invention to provide improved furniture structures and seating systems for comfortable seating which are user friendly and relatively simple in design, components, assembly and operation, and which eliminate the need for tools and provide for increased stability.

It is yet another objective of the present invention to provide improved furniture structures that provide greater uniformity of support while minimizing the number of components required and eliminate extraneous hardware, support members, brackets and cross rails.

It is yet another objective of the present invention to provide improved furniture designs that are superior to prior designs and provides for flexible, self-tensioning and self-stabilizing seats.

Finally, it is an objective of the present invention to provide an improved furniture designs that are cost effective and operationally efficient while incorporating the above-mentioned objectives and features.

SUMMARY OF THE INVENTION

The improved furniture designs disclosed herein utilize tension-stabilized frame assemblies to form simplified flat packing furniture that eliminates all hardware, fasteners, welds and braces. In addition to simplifying assembly, these pre-tensioned structures provide improved stability, uniformity of support and visual aesthetics.

The instant inventions and seating systems teach the use of furniture frames consisting of formed tubes that interconnect but remain unstable until the application, positioning and sliding engagement of a surface element or cover material alone tensions and stabilizes them, resulting in structures that behave as singular springs under tension. Forces applied to these structures are absorbed and counteracted by the overall balancing of tension and compression. This self-stabilization function is both rare and remarkable because it only exists in conjunction with the idealized mechanical characteristic of distributed compliance, where strength is maximized by distributing stress uniformly throughout a structure. This advantage does not exist in previous knock down furniture structures, which are classified as lumped compliance devices because they concentrate stress on specific points.

BRIEF DESCRIPTION OF THE DRAWINGS

The invention may be better understood by reference to the drawings in which.

DETAILED DESCRIPTION OF PREFERRED EMBODIMENTS

The present invention may be understood more readily by reference to the following detailed description taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges or lengths may be expressed generally herein, for example "shorter", from "about" or "approximately" one particular value or reference and/or to "about" or "approximately" another particular value or reference. Similarly, "outwardly" is used in its general definition without a particular range or value. When such a range, length or term is expressed, another embodiment includes from the one particular value and/or to the other particular value. Similarly, when values or terms are expressed as approximations, by use of an antecedent "about," or similar term it will be understood that the particular value forms another embodiment.

Figure 1A:
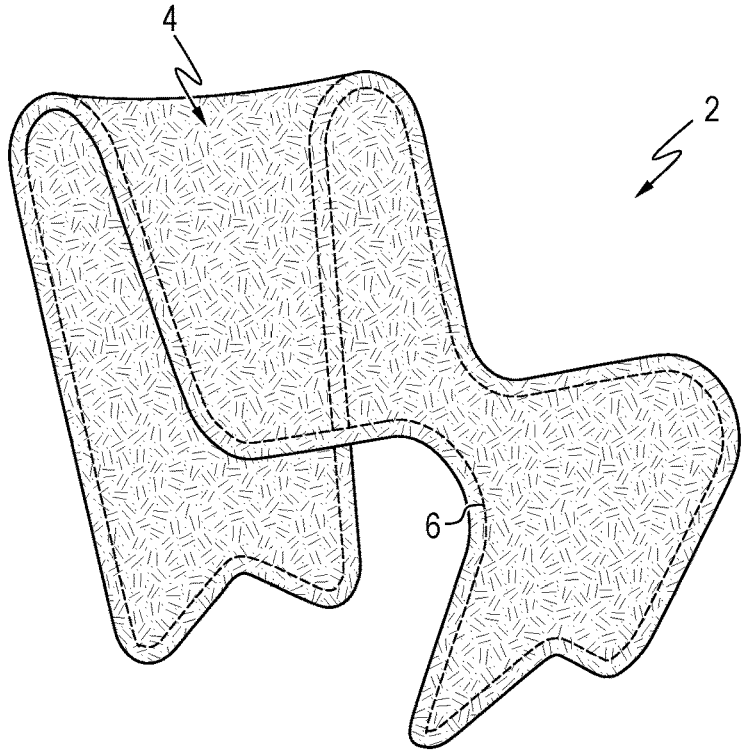
FIG. 1A is a perspective view of an embodiment of the inventive seating system in an assembled chair design.

With reference to FIG. 1A, the instant seating system 2 is shown in the furniture configuration of a chair, wherein the surface cover 4 has been attached to the frame assembly 6 through sliding engagement that provides the tension-stabilization as hereinafter described.

Figure 1B:
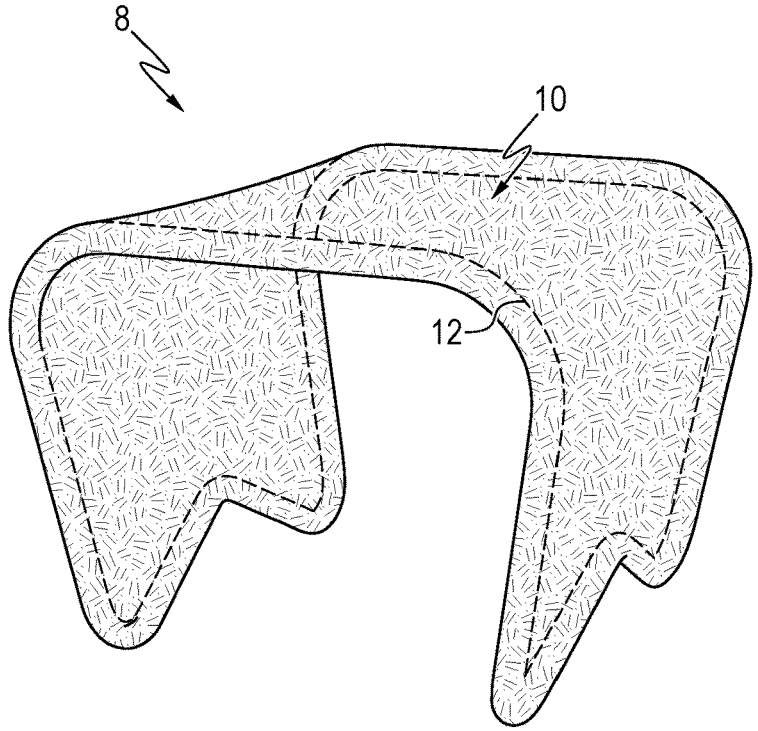
FIG. 1B is a perspective view of an embodiment of the inventive seating system in an assembled ottoman design.

FIG. 1B is an alternative embodiment of the seating system in the configuration of an ottoman, where the surface cover 10 has been attached to frame assembly 12 through sliding engagement that provides the tension-stabilization as further described hereinafter.

Figure 2A:
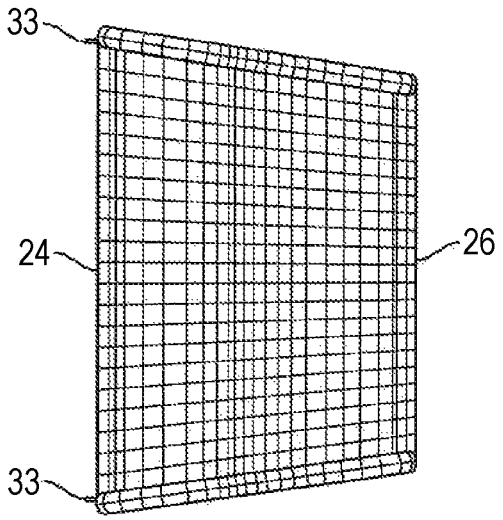
FIG. 2A is a top plan view of an alternative embodiment of the inventive seating system.
Figure 2B:
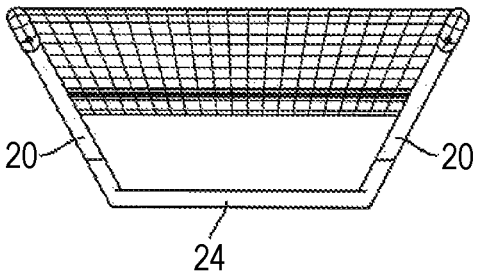
FIG. 2B is a rear view of the apparatus shown in FIG. 2A.
Figure 2C:
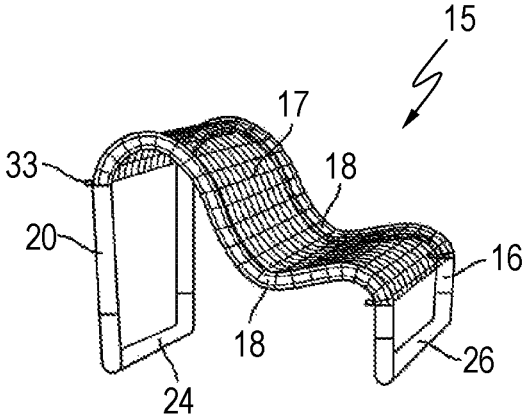
FIG. 2C is a perspective side view of the apparatus shown in FIG. 2A.

FIGS. 2A, 2B and 2C illustrate an alternative embodiment for the tensioned net furniture. In this embodiment, lower cross rails 24 and 26 are used to receive side rail sections 16 and 20. In this embodiment, the side rails are received within and secured by lower cross rails 24 and 26 respectively. The cross rails are conveniently placed on any surface, floor or deck, and can either be secured thereto or be freely movable. Side rails 18, and sections 16 and 20, are inserted within receptive sockets or sleeves of cross rails 24 and 26.

With respect to all the furniture embodiments described herein, the inserted side rails and cross rails together form the non-rigid and unstable frame assembly. These frames are unstable because the male-female socket connections between the rails allow the rails and frame to rotate freely. The instability allows the alignment of four interconnected tubes to change as forces are applied to the assembly. Applying the cover material restricts that alignment elastically, creating a restoring force that returns the tubes to their intended generally 90 degree angle. It is only when the surface cover material is attached to the frame assembly that the compression and tension forces are applied, forming a generally rigid and stable furniture piece. The upwardly and outwardly shaped base cross rails are essential to that stability because they ensure the engagement of the frame connections. Attaching the cover in the methods described herein pulls the frame into a tensioned and stable position and configuration along with the surface material.

The tubular side rails 18 include a central section, and forward sections 16 and rear sections 20 which fit and are received into sleeved peripheral edges of net 17. Net 17 is positioned in tensioned and sliding engagement about the side rails 18 stabilizing the entire chair apparatus as further described below. Alternatives to the net 17 include meshed or conventional fabrics, textiles, composite rubber or plastic materials, or similar products, which as an option may be wind resistant or allowing for airflow there through.

As indicated, the tubular side rails are supported by sockets in the cross rails, wherein opposite sides of the side rails themselves include lower sections which are inserted into the sockets in a male member—female member configuration. The side rails can include pegs for securing the net and various accessories, or tapered end sections which fit with within the sockets.

The seating surface can be a composite material, textile material, fabric or net stretched tightly between the side rails. The covers can be tubular in form or they can have sleeves within their periphery, and the rails fit within the sleeves. One particular material, UHMWPE fiber, is particularly suited for the nets and Nylon/Polyurethane knits are well suited for textile covers. The rails are preferably made of steel or aluminum, although other suitable materials can be utilized.

It can be seen that the rear sections 20 of the side rails are angled in an outward direction away from one-other. The outward angling of the rails is a key element of the novel material tensioning system. Assembly begins by inserting the rails into the base cross rails while the material 17 is pulled down to the lower, narrower front end sections 16. As the material is pulled toward the taller rear end sections 20 of the rails, the increased width between rails, because of the outward angling and the front sections 16 being shorter than the rear sections 20, creates tension in the material with forces pulling the side rails inwardly stabilizing the furniture cover, frame and assembly. Note the general trapezoidal shape of the net or material 17 illustrated in FIG. 2A through 2C, which is created by the side rail sections mentioned in the outward angling.

In the tensioned mode, the material can be secured at the top end of the rails by pegs 33 as seen in FIGS. 2A and 2C, the pegs protruding through holes in the net in this embodiment. The material tension also locks the side rails into the cross rails or other structure to create general purpose seating.

FIG. 2B is a rear view of the furniture configuration shown in FIG. 2A.

FIG. 2C is a perspective side view of one particular side seat profile 15 of a chair of the tensioned net furniture as illustrated in FIG. 2A, which illustrates the profile of the chair created by the side rails and having a seat support and back support. Sliding the net forward about the rails releases the side to side tension. Sliding the net rearwardly creates the side to side tension that supports the user(s), and locks the side rails into the sockets of the bottom cross rails 24 and 26. Pegs 33 secure the net or other material as indicated above. This same material tensioning system, outward angling and seating applies to a variety of products, including chairs, loveseats, chaise lounges, and ottomans amongst others. These structures may also be used to replace the conventional frames inside padded and upholstered furniture. Those embodiments may utilize removable covers that enable the item to be disassembled for efficient transport.

Figure 3A:
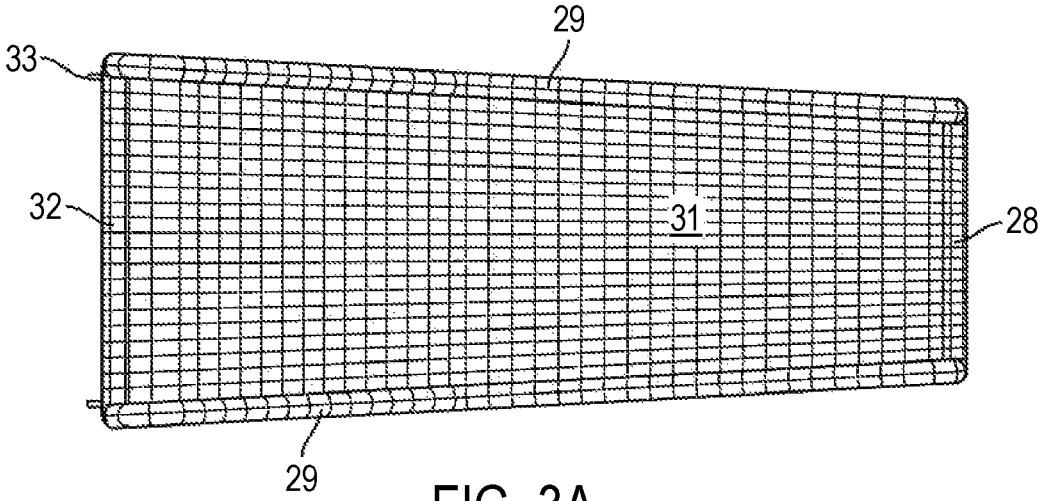
FIG. 3A is a top plan view of an alternative embodiment of the inventive seating system.
Figure 3B:
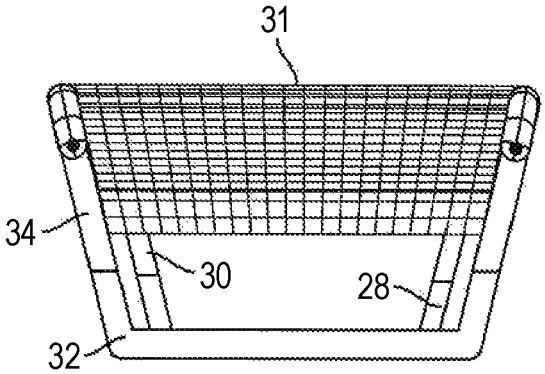
FIG. 3B is a rear view of the apparatus shown in FIG. 3A.
Figure 3C:
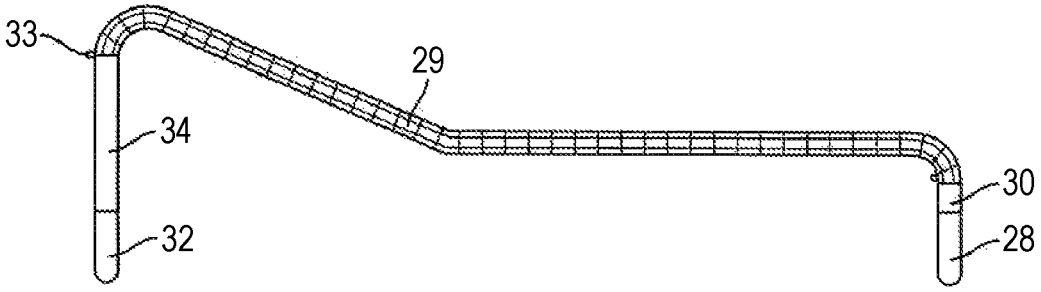
FIG. 3C is a side view of the apparatus shown in FIG. 3A.

FIGS. 3A, 3B and 3C illustrate the instant seating system in the embodiment of a tensioned chaise lounge. Side rails 29 are shaped to that of a conventional chaise lounge profile, and can be modified in design accordingly. Bottom cross rails 28 and 32 receive side rail sections 30 and 34 respectively. Net seating section 31 is assembled about side rails in the same fashion as indicated above with FIGS. 2A through 2C. Pegs 33 act to secure the net or cover material as indicated.

Figure 4A:
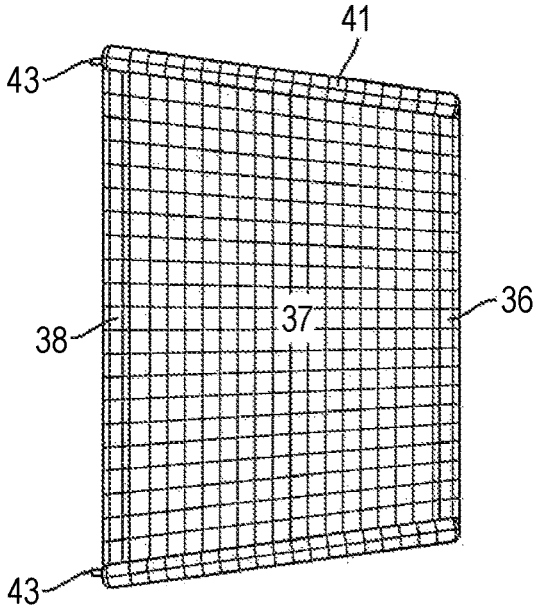
FIG. 4A is a top plan view of an alternative embodiment of the inventive seating system.
Figure 4B:
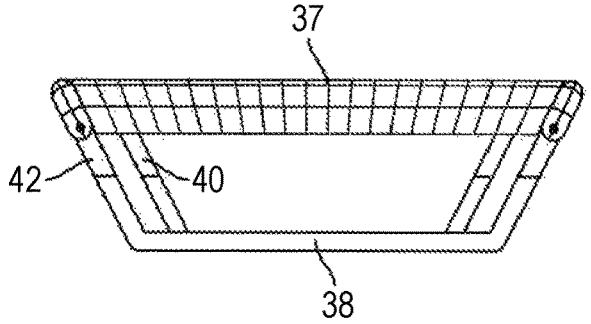
FIG. 4B is a rear view of the apparatus shown in FIG. 4A.
Figure 4C:
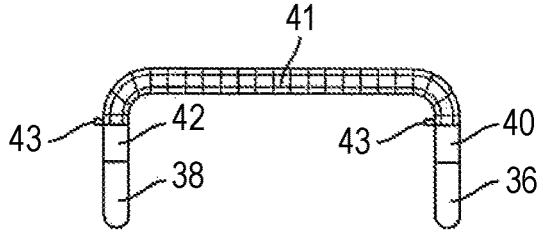
FIG. 4C is a side view of the apparatus shown in FIG. 4A.

FIGS. 4A, 4B and 4C illustrate the instant seating system in the embodiment of a tensioned net/mesh fabric ottoman. Side rails 41 are shaped to that of a conventional ottoman profile, and can be modified in design accordingly. Bottom cross rails 36 and 38 receive side rail sections 40 and 42 respectively. Net seating section 37 is assembled about side rails in the same fashion as indicated above with FIGS. 2A through 3C. Note in this embodiment, front rail sections 40 and 42 are the same height creating the generally level ottoman. Pegs 43 secure the net 37 to the rails.

Figure 5A:
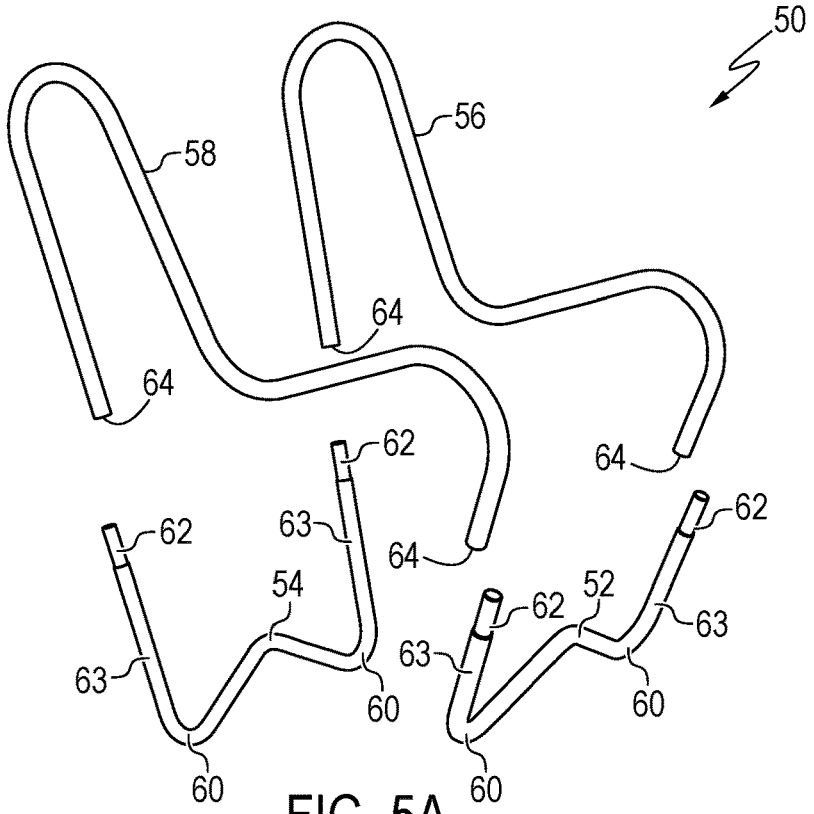
FIG. 5A is an exploded perspective view of an alternative embodiment of the inventive seating system in the configuration of a chair.

With reference to FIG. 5A, an alternative embodiment for the tension-stabilized furniture chair frame 50 is illustrated prior to assembly. This design is a chair having tubular lower front cross rail 52 and lower rear cross rail 54, and tubular side rail sections 56 and 58. In this design, the lower cross rails have minimal contact with the floor or deck the chair would be placed upon, and only contact the floor at contact points 60. However, as a matter of design choice, the lower cross rails could be a continuous horizontal rail along the floor.

As similarly mentioned previously, the tubular side rails are supported by male member—female member configurations, wherein male sections 62 of lower front cross rail 52 and lower rear cross rail 54 are received by open ends or sockets 64 in the side rails 56 and 58. Opposite sides of the side rails themselves include the lower section sockets to receive the male sections of the lower cross rails.

Lower cross rails 52 and 54 incorporate outwardly and upwardly widened leg members 63 that provide the tensioning and stabilization of the furniture in conjunction with the textile sleeve when attached. Front cross rail 52 is also shown being shorter than rear cross rail 54, and similarly the width of each of the lower cross rails can be varied to be equivalent, or one less than the other as desired. The widths can be varied to enhance the tension-stabilization of the furniture as the textile sleeve is attached.

Figure 5B:
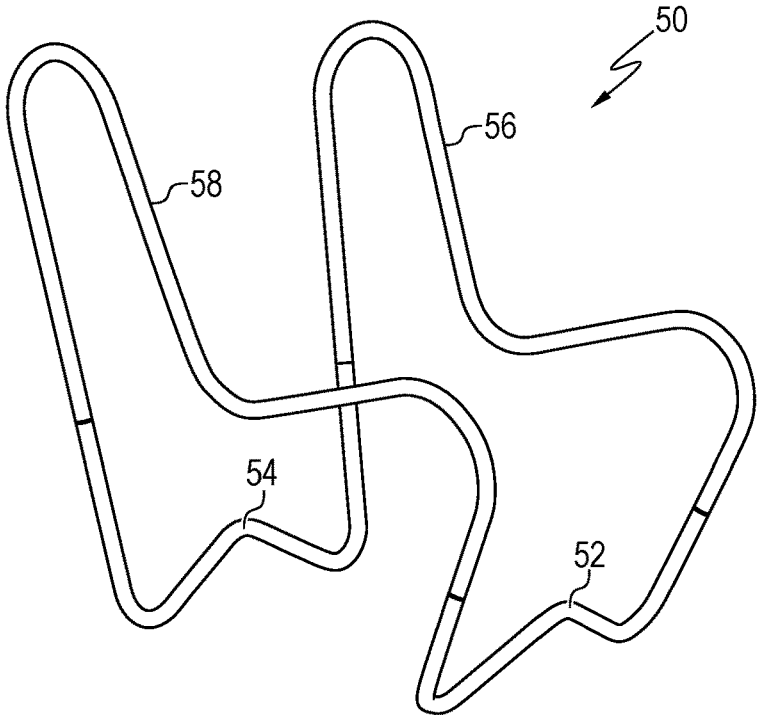
FIG. 5B is a perspective assembly view of the apparatus shown in FIG. 5A.

FIG. 5B is an assembled chair frame 50 and constitutes the complete chair frame. There are no other associated support members, hardware, cross bars, hinges, plates, straps or structures of any kind that are utilized or attached to the frame 50. The chair frame is solely comprised of the two side rails 56 and 58, and two lower base cross rails 52 and 54.

As described above, the inserted side rails and cross rails together remain a non-rigid and unstable frame assembly because their male-female socket connections are free to rotate. This instability allows the alignment of the four tubes to shift in three dimensions as forces are applied to the frame. Attaching the cover material to the frame assembly applies compression and tension forces that form a generally rigid and stable furniture piece. The upwardly and outwardly angled base cross rails ensure the proper engagement of the frame connections, even as uneven loads and forces are applied to the structure.

Figure 6A:
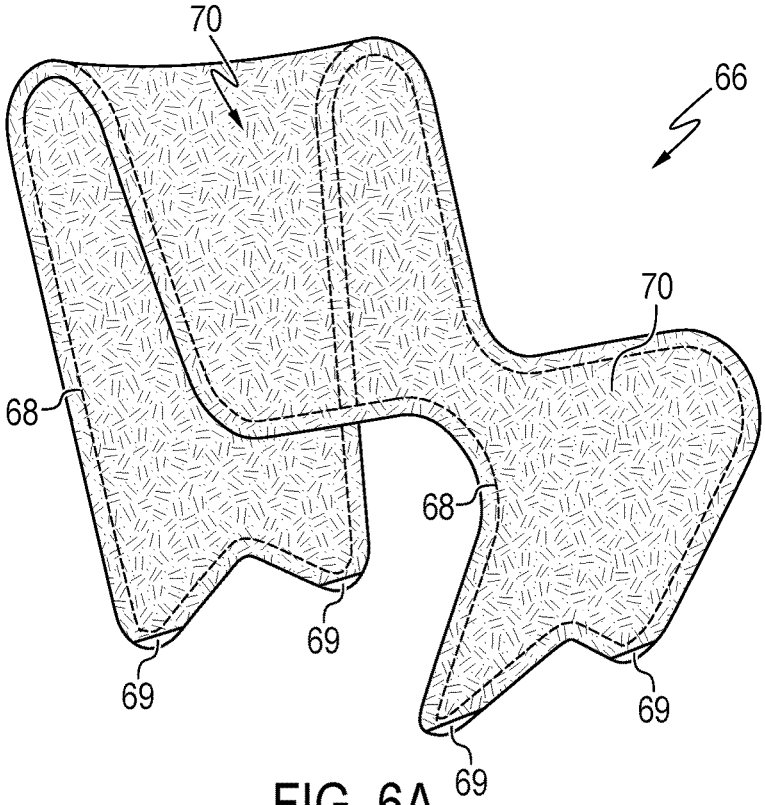
FIG. 6A is a perspective view of the apparatus shown in FIG. 5B with a surface cover attached.

FIG. 6A depicts the instant seating system in the completed furniture configuration of chair 66. The chair includes a fitted textile sleeve surface, the profile of the chair having a conventional seat support and back support as shown. The tension-stabilized chair 66 was assembled by attaching textile sleeve 70 over the frame assembly 68. The textile sleeve 70 constitutes the surface cover that has been attached to the frame assembly through sliding engagement that provides the instant stabilization based on the frame structure, tubular member designs and shape. As an option, sleeve 70 can include openings in the fabric ends as shown allowing for frame corners 69 to protrude through the openings to directly contact a floor or surface.

Assembly begins by connecting the four rails together with the frame turned upside down. An opening in the underside of the textile sleeve cover 70 serves as the entry point for the frame. Sliding the cover over the progressively widening frame, tensions and stabilizes it while forming the seating surface. The entry opening is located near one end of the fitted cover, allowing the cover to be secured by pulling it past the end of the frame and over the frame corners. Openings in the corners of the sleeve allow the corners of the frame to contact the floor.

Figure 6B:
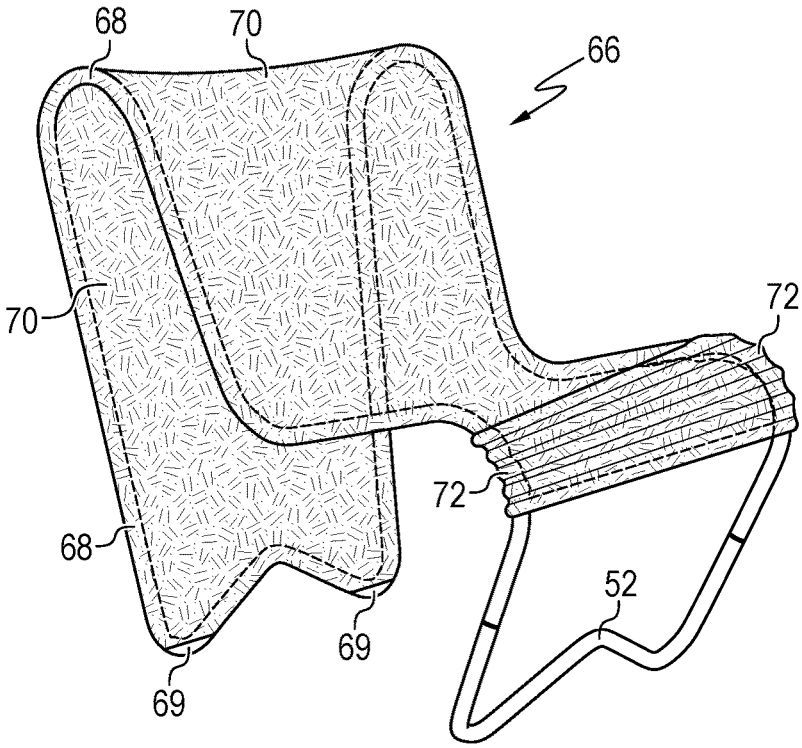
FIG. 6B is a perspective view of the apparatus shown in FIG. 5B with a surface cover partially attached.

FIG. 6B shows the textile sleeve 70 being attached to the frame assembly 68 through sliding engagement from the back of the chair towards the front cross rail 52. Bunched textile material 72 is illustrated as the as the material is being pulled downwardly toward the bottom of lower front cross rail 52, and when completed the chair is shown in FIG. 6A.

Figure 7A:
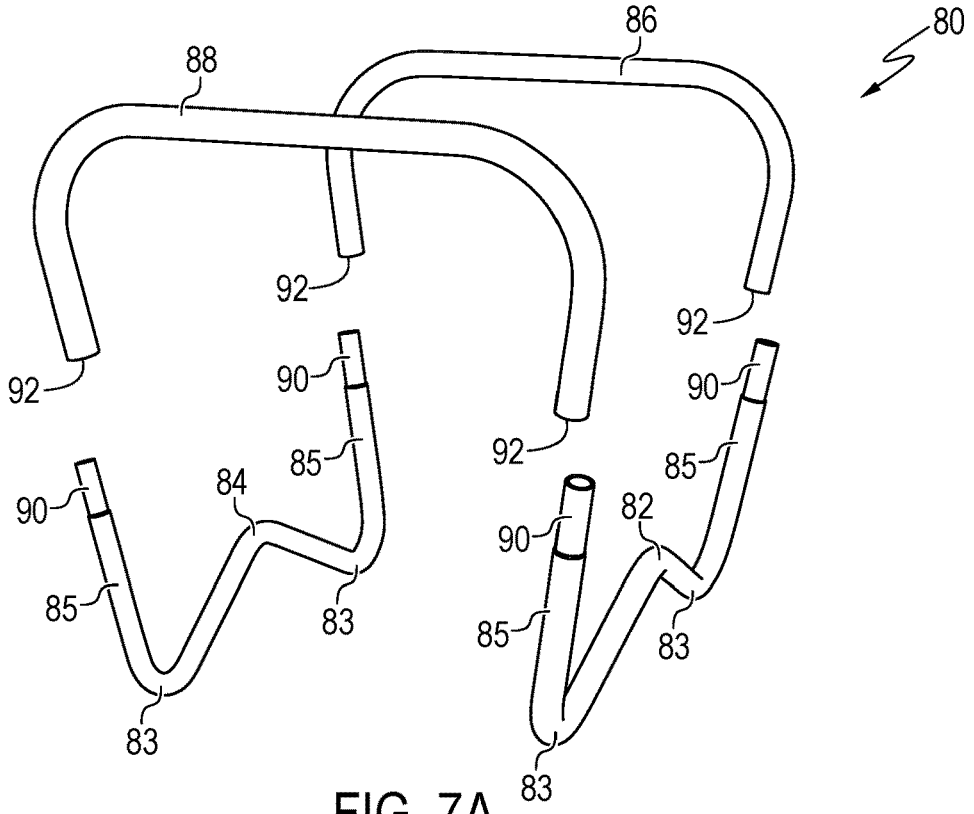
FIG. 7A is an exploded perspective view of an alternative embodiment of the inventive seating system in the configuration of an ottoman.

With reference to FIG. 7A, an alternative embodiment for the tension-stabilized furniture ottoman frame 80 is illustrated prior to assembly. This design is an ottoman having tubular lower front cross rail 82 and lower rear cross rail 84, and tubular side rail sections 86 and 88. In this design, the lower cross rails have minimal contact with the floor or deck the ottoman would be placed upon, and only contact the floor at contact points 83. However, as a matter of design choice, the lower cross rails could be a continuous horizontal rail along the floor.

As similarly described with respect to the chair design previously mentioned, the tubular side rails are supported by male member—female member configurations, wherein male sections 90 of lower front cross rail 82 and lower rear cross rail 84 are received by open ends or sockets 92 in the side rails 86 and 88. Opposite sides of the side rails themselves include the lower section sockets to receive the male sections of the lower cross rails.

Lower cross rails 82 and 84 incorporate outwardly and upwardly widened leg members 85 that provide the tensioning and stabilization of the furniture in conjunction with the textile sleeve when attached. Front cross rail 82 is also shown being generally equal to the width of rear cross rail 84 to provide the horizontal ottoman surface. The widths can be varied to enhance the tension-stabilization of the furniture as the textile sleeve is attached.

Figure 7B:
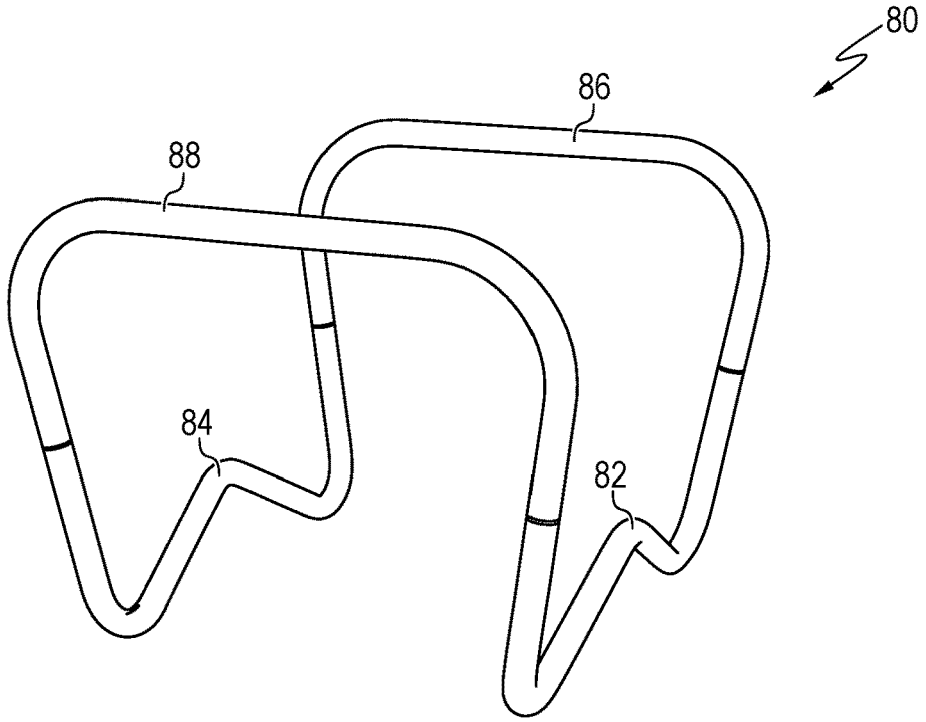
FIG. 7B is a perspective assembly view of the apparatus shown in FIG. 7A.

FIG. 7B is an assembled ottoman frame 80 and constitutes the completed ottoman frame. There are no other associated support members, hardware, cross bars, hinges, plates, straps or structures of any kind that are utilized or attached to the frame 80. The ottoman frame is solely comprised of the two side rails 86 and 88, and two lower base cross rails 82 and 84.

Figure 8:
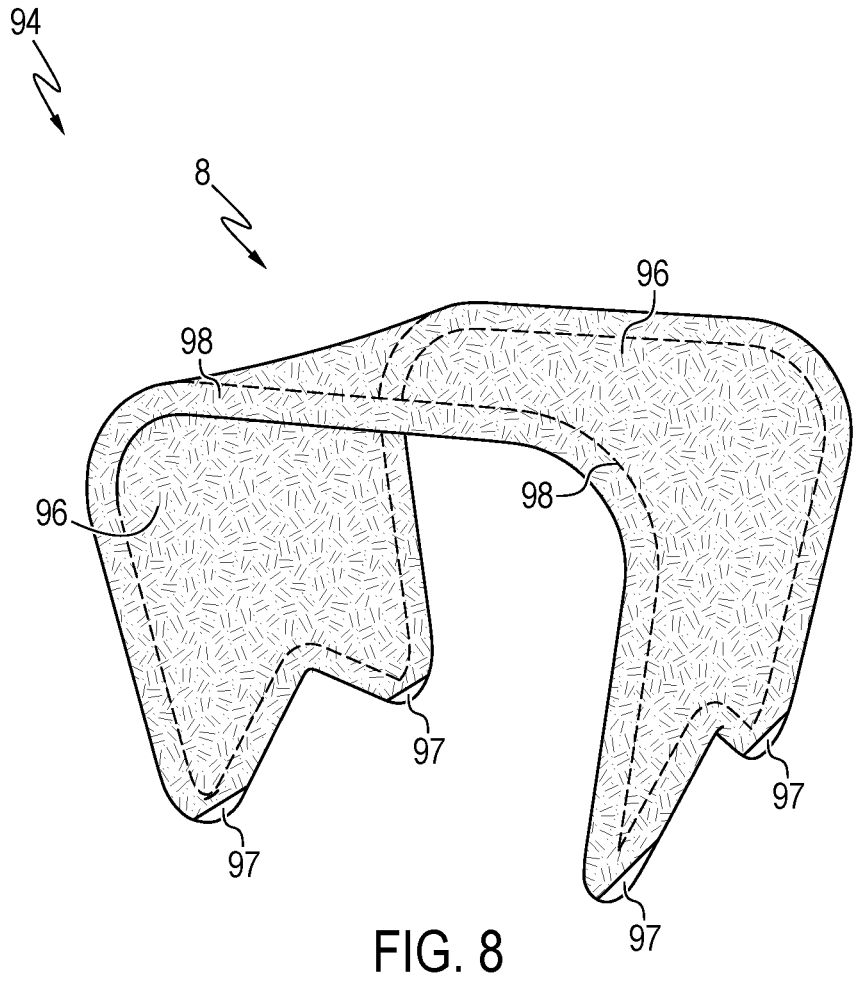
FIG. 8 is a perspective view of the apparatus shown in FIG. 7B with a surface cover attached.

FIG. 8 illustrates the instant seating system in the completed furniture configuration of ottoman 94. The ottoman includes a textile sleeve surface, the profile of the ottoman having a conventional generally horizontal seat surface as shown. The tension-stabilized ottoman 94 was assembled by attaching textile sleeve 96 over the frame assembly 98. The textile sleeve 96 constitutes the surface cover that has been attached to the frame assembly through sliding engagement that provides the instant stabilization based on the frame structure, tubular member designs and shape. As an option, sleeve 96 can include openings in the fabric ends as shown allowing for frame corners 97 to protrude through the openings to directly contact a floor or surface.

Assembly also begins by connecting the four rails together with the frame turned upside down. An opening in the underside of the textile sleeve cover 96 serves as the entry point for the frame. Sliding the cover over the progressively widening frame, tensions and stabilizes it while forming the seating surface. The entry opening is located near one end of the cover, allowing the cover to be secured by pulling it past the end of the frame and over the frame corners. Openings in the corners of the sleeve also may allow the corners of the frame to contact the floor.

With regard to all of the instant furniture embodiments and designs, joining the side rails and widening cross rails with a textile membrane creates a fundamentally simple self-tensioning structure with the extraordinary physical characteristic of uniformly distributed tension. This rare attribute, known as distributed compliance as previously mentioned, is a structural ideal that maximizes strength and stability without rigidity or high tension. This advantage does not exist in previous framed seating structures, which are classified as lumped compliance devices because they concentrate tension on one or more points. Benefits of distributed compliance include self-stabilization, extreme reliability and safety.

The most significant differences between the current inventions and previous designs are the means employed to support the tension-stabilized furniture designs with material and side rails in a seat profile with minimal structural components.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

It is to be understood that both the foregoing descriptions are exemplary and explanatory only, and are not restrictive of the methods and devices described herein. It is intended that the scope of the invention be defined by the Claims appended hereto and their equivalents.

What is claimed is:

1. A tensioned-stabilized, flexible seating system for furniture, comprising:

a plurality of side rails;

said side rails having forward and rear sections;

a plurality of cross rails, each said cross rail having cross rail leg members on opposite ends;

said cross rail leg members being angled outwardly and upwardly from said cross rail;

each said side rail forward section being inserted into a cross rail leg member of one said cross rail, and each said side rail rear section being inserted into a cross rail leg member of another said cross rail;

said side rails being angled outwardly and upwardly from said cross rails;

said side rails when inserted into said cross rails together forming a non-rigid and unstable frame assembly;

said unstable frame assembly allowing an undesirable rotational change in alignment of said frame assembly upon application of pressure forces;

a flexible seat material, said side rails supporting said seat material, said flexible seat material being resilient and deformable;

said flexible seat material being a removable sleeve being pulled over and attached to said cross rails and side rails from one said cross rail to another said cross rail;

said flexible seat material alone compressing said side rails and cross rails, tensioning and stabilizing said unstable frame assembly when attached thereto;

said flexible seat material being moveable in sliding engagement with said side rails;

wherein sliding said seat material forward releases side-to-side tension and sliding said seat material rearward creates side-to-side tension; and said tension supports users and locks said side rails in place as secured to said cross rails.

2. The apparatus of claim 1, wherein said flexible seat material is a textile sleeve having an open end, said textile sleeve being pulled over said cross rails and said side rails in sliding engagement.

3. The apparatus of claim 1, wherein said flexible seat material is a net having an open end, said net being pulled over said cross rails and said side rails in sliding engagement.

4. The apparatus of claim 1, further comprising:

wherein sliding said seat material reward releases side-to-side tension and sliding said seat material forward creates side-to-side tension; and said tension supports users and locks said side rails in place as secured to said cross rails.

5. The apparatus of claim 2, further comprising:

said side rails being shaped to define the profile of furniture.

6. The apparatus of claim 3, further comprising:

said side rails being shaped to define the profile of furniture.

7. The apparatus of claim 5, further comprising:

said side rails having central sections interposed said forward and rear sections;

said forward sections being lower than said rear sections; and said central sections defining the profile of said furniture.

8. The apparatus of claim 6, further comprising:

said side rails having central sections interposed said forward and rear sections;

said forward sections being lower than said rear sections; and said central sections defining the profile of said furniture.

9. The apparatus of claim 1, further comprising:

said side rails being inserted into said cross rails with male-female connection means in said side rails and said cross rails leg members at their respective opposite ends.

10. The apparatus of claim 1, further comprising:

said frame assembly having no additional support cross bars, pipes or hardware, and is solely assembled utilizing said side rails, said cross rails and said flexible seat material, and tensioned thereby.

* * * * *